United States Patent [19]

Terrell, I et al.

[11] 4,428,430

[45] Jan. 31, 1984

[54] CHEMICAL METHOD AND APPARATUS FOR PERFORATING DRILL COLLARS

[75] Inventors: Jamie B. Terrell, I; Jamie B. Terrell, II, both of Fort Worth, Tex.

[73] Assignee: Gearhart Industries, Inc., Forth Worth, Tex.

[21] Appl. No.: 225,513

[22] Filed: Jan. 13, 1981

[51] Int. Cl.[3] ..... E21B 43/11; E21B 43/19

[52] U.S. Cl. ..... 166/298; 166/55; 166/63; 166/72; 166/212

[58] Field of Search ..... 166/55, 55.1, 57, 63, 166/72, 120, 178, 212, 297, 298, 299, 323

[56] References Cited

U.S. PATENT DOCUMENTS

| | | | |
|---|---|---|---|
| 2,918,125 | 12/1959 | Sweetman | 166/297 |
| 3,026,939 | 3/1962 | Sweetman | 166/63 X |
| 3,076,507 | 2/1963 | Sweetman | 166/297 |
| 3,305,018 | 2/1967 | White, Jr. et al. | 166/297 |
| 3,329,208 | 7/1967 | Voetter | 166/63 |
| 3,376,927 | 4/1968 | Brown | 166/55.8 X |
| 3,720,262 | 3/1973 | Grable | 166/298 |
| 4,125,161 | 11/1978 | Chammas | 166/63 X |
| 4,158,389 | 6/1979 | Chammas et al. | 166/55 X |
| 4,180,131 | 12/1979 | Chammas | 166/55 |
| 4,250,960 | 2/1981 | Chammas | 166/55 |
| 4,345,646 | 8/1982 | Terrell | 166/55 |

*Primary Examiner*—James A. Leppink
*Assistant Examiner*—George A. Suchfield
*Attorney, Agent, or Firm*—Hubbard, Thurman, Turner & Tucker

[57] ABSTRACT

Discloses a method and apparatus to help provide fluid pressure in a well bore sufficient to overcome in situ earth formation pressures by perforating a circulation port through the sidewall of a drill collar above the drill bit to provide circulation of weighted drilling fluid down through the drill spring and back up the well annulus. Includes the lowering of a chemical reactant wireline perforating tool to a designated position within a drill collar, placing a single chemical flow jet into position addressing the sidewall of the drill collar, forcing the chemical reactant through the jet under high pressure and at high temperature to react with the drill collar metal and thereby remove a portion of the metal with the remaining metal defining a fluid circulation port through the drill collar wall, and pumping fluid through the port to establish circulation. Apparatus includes a tool body defining a single fluid flow jet, pressure actuated slips with the body to support the body against a vertical movement within the drill pipe, a body of chemical within the tool, a reaction section to heat the chemical, a pressure responsive decentralizing mechanism to position to the tool and thereby place the flow jet into position to direct the chemical directly onto the interior wall of the drill collar, and an electrically ignited propellant within the tool to set the slips, move the chemical through the reactant body, actuate the decentralizing mechanism, and force the chemical into reacting connection with the drill collar wall.

12 Claims, 3 Drawing Figures

CHEMICAL METHOD AND APPARATUS FOR PERFORATING DRILL COLLARS

This invention generally pertains to perforating a well conduit to establish fluid circulation, and more particularly pertains to a chemical method and apparatus to perforate a port through a drill collar near the drill bit to maintain or increase the mud circulation in a well being drilled.

BACKGROUND OF THE INVENTION

During the drilling of oil in gas wells, a weighted drilling fluid or mud is circulated down the drill pipe under pressure, through an assembly of drill collars, through the jets or nozzles of a rotary drill bit, and back to the surface through the annulus between the pipe and the drill hole.

The specific weight of the drilling mud is adjusted and maintained such that the column of mud above any respective well formation exerts a hydrostatic pressure which is greater than the fluid pressure within such formation.

In situations when the drilling mud pressure is allowed to become less than a well formation pressure, then fluids from that formation will blow into the well annulus, forcing drilling mud up out of the well and further reducing the effective drilling mud hydrostatic pressure, until the well blows out from the formation pressure.

When the well "kicks" (when the formation pressure begins to overcome the drilling mud hydrostatic pressure) a heavier mud must be circulated into the well to create a greater hydrostatic pressure. The fluid circulation must be maintained, and frequently increased, during well control operations where the well is kicking or blowing out.

It is standard practice to use drill bits having small jet nozzles which limit and partially plug the circulating flow rates of the drilling mud through the drilling string. Occasionally, the mud may contain entrained loss circulation materials which are intended to clog the interstices of a formation where the fluid may be escaping. The loss circulation materials can sometimes tend to plug the jet nozzles.

When an increase in drilling mud circulation through the well is needed, an additional fluid circulation port through the wall of the drill collar may become very desirable. A chemical perforator of the present invention provides an improved approach to providing such an additional circulation port which overcomes many of the negative aspects of other approaches.

Drill collars have been perforated with shaped explosive charges. If the drill collars are eight inches or more in diameter, for example, the wall of the collar is about two inches thick and the shaped charges are not effective to produce a hole large enough for adequate drilling mud circulation.

Shaped charges or similar explosives also have been used to sever the drill collar above the drill bit. The mud circulation is then of course at a maximum, with the severed drill collar, to control the well. However, the portion of drill collar remaining in the hole and the drill bit must be fished out in a clean-up operation after the well is brought back under control, at a considerable expense in rig time.

Generally unsuccessful attempts have been made also to blow the nozzles out of the bits with "junk shots".

The chemical perforator of the present invention provides a clean and adequate mud circulating port hole with no subsequent fishing operation or other clean up problem.

Well conduit cut-off tools of the chemical type have been in use for several years. Such cutting tools are disclosed in U.S. Pat. Nos. 2,918,125 and 3,076,507. Specifically, the chemical perforator of the present invention incorporates a portion of the cut-off tool disclosed in commonly assigned and co-pending U.S. application Ser. No. 078,472, Filed Sept. 24, 1979, now U.S. Pat. No. 4,345,646. The disclosures of these patents and the pending application are hereby incorporated by reference as background information.

SUMMARY OF THE INVENTION

In summary, the invention provides a method and apparatus to provide fluid pressure in a well bore sufficient to overcome in situ earth formation pressures by perforating a circulation port through the sidewall of a drill collar above the drill bit and thus provide circulation of weighted drilling fluid down through the drill string and back up the well annulus. The steps include the lowering of a chemical reactant wireline perforating tool to a designated position within a drill collar, placing a single chemical flow jet into position addressing the sidewall of the drill collar, forcing the chemical reactant through the jet under high pressure and at high temperature to react with the drill collar metal and thereby remove a portion of the metal with the remaining metal defining a fluid circulation port through the drill collar wall, and pumping fluid through the port to establish circulation. The apparatus includes a tool body defining a single fluid flow jet, pressure actuated slips with the body to support the body against a vertical movement within the drill pipe, a body of chemical within the tool, a reaction section to heat the chemical, a pressure responsive decentralizing mechanism to position to the tool and thereby place the flow jet into position to direct the chemical directly onto the interior wall of the drill collar, and an electrically ignited propellant within the tool to set the slips, move the chemical through the reactant body, actuate the decentralizing mechanism, and force the chemical into reacting connection with the drill collar wall.

OBJECTS OF THE INVENTION

An object of the present invention is to provide a clean flow port hole of generous flow capacity through the wall of a drill collar (which may be greater than 2" in thickness, for example).

Another object of the invention is to provide a port hole through the wall of a drill collar and leave no debris or trash in the well.

Still another object of the present invention is to provide means to perforate the wall of a drill collar in a sure and dependable fashion when the well may be kicking or even blowing out.

Other objects and advantages will become apparant with reference to the drawing and the following detailed specification.

REFERRING TO THE DRAWINGS

FIG. 1 is a schematic elevational cross-sectional view of the lower end of a drilling string including the drill bit and a portion of the drill collar with the perforating tool of the present invention inserted within the drill collar and having made a port hole through the wall of the drill collar;

FIG. 2 illustrates schematically in cross-section the lower end of the perforating tool in its initial position while being lowered into the drill pipe and drill collar; and FIG. 3 illustrates schematically in cross-section the lower end of the perforating tool after the tool has been displaced over against the inner wall of the drill collar and actuated to complete a port hole through the wall of the collar.

DESCRIPTION OF THE PREFERRED EMBODIMENT

Figure 1:
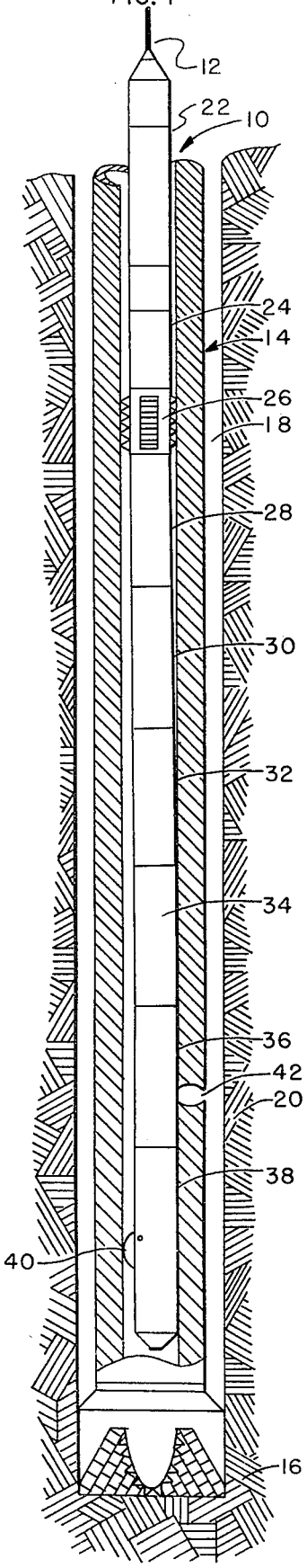

First referring to FIG. 1, there is shown a tool 10 of the present invention suspended from an electrical wireline 12 through a drilling string into a drill collar assembly 14 to a position slightly above a drill bit 16. The drill collars 14 and bit 16 are shown at the bottom of a well bore 18. The drill bit 16 is shown as having drilled into a well formation 20 which may contain oil or gas under high pressure.

Beginning at its upper end, the well tool 10 is seen to be comprised of a jar section 22, a propellant section 24, a slip section 26, and a plurality of chemical sections 28, 30, and 32, for example.

Below the acid section 32 is shown a reactant section 34 connected to perforating head section 36 and a decentralizing section 38 shown with a decentralizing cam 40. In FIG. 1 the cam assembly 40 urges the perforating section 36 and section 38 against the sidewall of the drill collar 14.

As an example, a prototype of the tool 10 is about 18 feet long and 2 inches in diameter and, as seen in FIG. 1, is slightly flexible such that the bottom of the tool may be moved close against the interior wall of the drill collar while its upper end is substantially centralized by the slip section 26. In such instance the interior diameter of the drill collar may be 2.75 inches in diameter, for example.

Also shown in FIG. 1 is a flow circulation port 42 opening through the sidewall of the drill collar 14. The port 42 has been formed by the reaction of a chemical which has been forced at high pressure and at a high temperature from the tool onto the inner wall of the drill collar 14.

Figure 2:
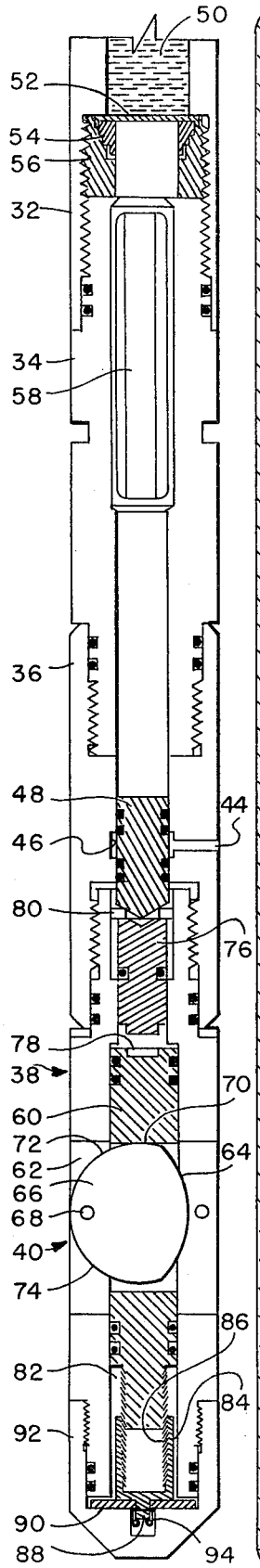

FIG. 2 illustrates the lower portion of tool 10 as the tool is being lowered into the drill collar and before being actuated. Shown is the chemical section 32, the reactant section 34, the jetting head section 36, and the decentralizing section 38.

The body of the jetting section 36 is seen to define a jetting orifice 44 extending from the outside of section 36 into a central bore having an undercut portion extending around the interior of the bore. As shown, the orifice 44 is closed off from the interior of the tool by a closure head piston 48 with the piston 48 and the undercut portion defining an annulus 46 extending around the piston and in communication with the jet orifice 44. The piston 48 is sealed within the bore of the section 36 above and below the annular 46 by appropriate seals which may be O-rings as illustrated.

The chemical section 32 is seen to define a bore containing a chemical reactant 50 which is confined within the section 32 by means of a rupturable diaphram 52. Diaphram 52 is secured in sealed relation within section 32 by a retainer insert 54 and a threaded retainer bushing 56 as shown.

The chemical 50 may be one of the several halogen oxidizer compounds which are extremely reactive with materials under conditions of high temperature. Bromine trifluoride ($BrF_3$) is an exemplary halogen which is suitable for use. More information concerning the use of these halogens as cutting chemicals is set forth in the previously referenced patents.

The reactant section 34 defines a bore which is seen to contain a reactant body 58, sometimes called the "ignitor hair" or "ignitor wool", which purpose is to react through rapid oxidation with the chemical 50 passing through section 34 to heat the chemical to an extremely high temperature.

The ignitor hair 58 may be a packing of steel wool or other readily oxidizable material. The steel wool may be advantageously coated with oil if desired.

As previously mentioned, the jetting head section 36 includes the head piston 48.

Figure 3:
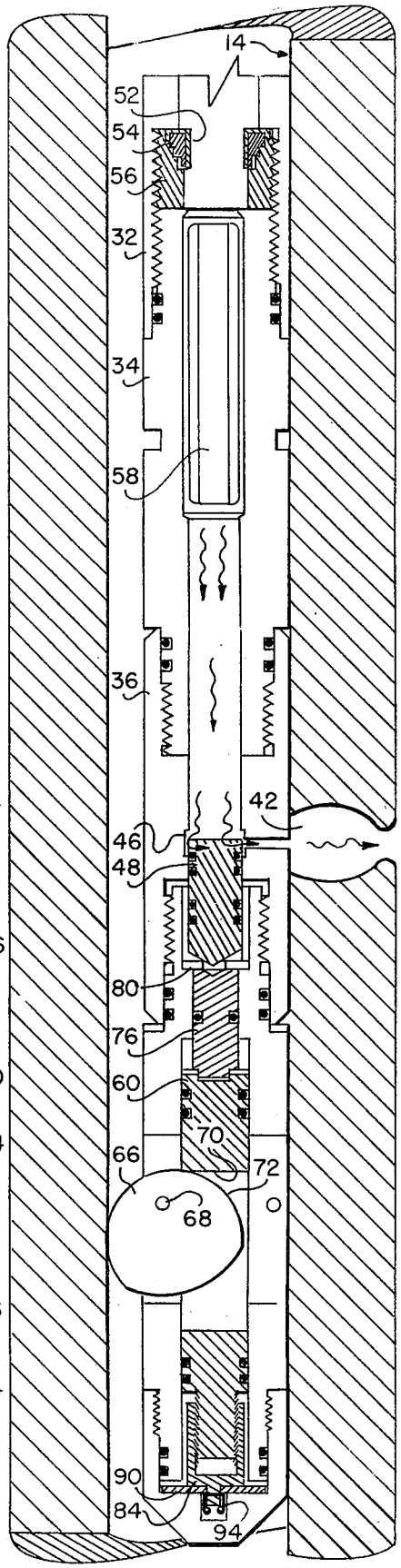

The decentralizing section 38 is seen to define a central bore containing a slidable actuating shaft 60 which may be moved from an upper position such as shown in FIG. 2 to a lower position such as shown in FIG. 3, and later described.

A vertical slot 62 is transversely defined through the side of section 38 to register with a vertical slot 64 defined transversely through the actuating shaft 60.

As part of the camming assembly 40, a decentralizing cam 66 is mounted in pivoted relation within the slots 62 and 64 by means of a pivot pin 68.

The cam 66 is of generally disc shape and mounted eccentrically within the slot 62 such that a camming surface 72 extends upwardly and away from the pivot pin 68 into contact with a camming face 70 defined within the shaft 60 at the upper end of the shaft slot 64.

With the structure as provided and shown, downward movement of the shaft 60 forces the cam face 70 against the cam surface 72 of the cam 66 and urges the cam 66 around the pivot pin 68 such that a displacement surface 74 is extended outwardly from the section 38 and the tool 10 in proportion to the downward movement of the shaft 60 within the section 38.

Assuming the tool 10 to be 2 inches in outside diameter as previously given and the internal bore of the drill collar 14 to be $2\frac{3}{4}$ inches in inside diameter, then a $\frac{3}{4}$ inch extension of the displacement surface 74 of the cam 66 from the decentralizing section 38 of tool will place the lower end of the tool 10, including the jetting head 36 and section 38, into close contact against the wall of the drill collar 14. Such close contact insures that the outlet of the jet orifice 44 is addressed squarely against the interior face of the wall of drill collar 14.

Disposed in slidable relation within the bore of section 38 at its upper end is an impact piston 76 which is mounted in slightly spaced apart relation from an anvil surface 78 defined at the upper end of the shaft 60.

An impact washer 80 is mounted above the impact piston 76 and between the impact piston 76 and the head piston 48 at the threaded connection of the jetting head section 36 with the section 38. The impact washer 80 is slidably fitted into a counter bore at the upper end of section 38 such that it may be moved downwardly a designated distance to be retained from further movement by the counter bore shoulder. Retension of the impact washer 80 from further downward movement also will restrict further downward movement of the head piston 48 when structurally arranged as shown in FIGS. 2 and 3.

The lower end of the actuating shaft 60 has provided thereon a shaft of reduced diameter on which are formed buttress threads 82. The buttress threads 82 are fitted into a ratchet sleeve 84 having corresponding buttress threads 86 formed in the interior of the sleeve. The sleeve 84 is slotted along the length of the buttress threads and has sufficient resilience to flex outwardly as the threads 82 are pushed into the threads 86. The sleeve 84 as slotted is divided into a plurality of sections or leaves (not shown) to give such flexibility.

The lower end of sleeve 84 terminates in a wall having a stem 88 projecting downwardly through a hole in a shearing washer 90 which is retained at the bottom of the section 38 by means of a nose cap 92. A transverse hole is provided through the stem 88 to receive a shearing wire or pin 94 in a manner such that the sleeve 84 is retained down against the shearing washer 90 by means of the shear pin 94.

As provided, an upward pull of designated force by the ratchet sleeve 84 and stem 88 away from the washer 90 will shear the pin 94 and allow the ratchet sleeve to move upwardly within the section 38.

OPERATION OF THE PREFERRED EMBODIMENT

The tool 10 is usually brought into employment when a well being drilled encounters a formation having in situ pressures which are sufficiently greater than the hydrostatic pressures of the drilling mud above the formation to cause the well to "kick" or tend to blow out. This condition may be caused by inadequate circulation of the drilling fluid through the drill bit nozzles, and possibly caused by partial plugging of the nozzles.

When employed, the tool 10 is lowered into the drilling string and into the drilling collar 14 a designated distance above the drill bit 16 as shown in FIG. 1. At this time the tool 10 has not been decentralized by the cam means 40 as shown but rather is suspended freely within the bore of the drill collar 14.

To actuate the tool 10, the propellant (not shown) in the propellant section 24 is electrically ignited through the electrical cable 12 to ignite the propellant. Upon ignition, the propellant begins to burn and generate a pressure which first extends the slips in the slip section 26 into setting position within drill collar 14. Then, the pressure proceeds to rupture the successive upper and lower diaphrams (not shown) of the successive acid chambers 28, 30, and 32 until all the chemical is moving through the ruptured diaphram 52 as shown in FIG. 3.

The propellant pressure drives the chemical into and through the reactant body 58 where reaction of the chemical with the wool or like material 58 heats the chemical to a very high temperature.

The chemical is successively driven down through the tool 10 to encounter the head piston 48 and move piston 48 downwardly against the impact piston 76, driving the piston 76 forcefully against the anvil surface 78 of the actuating shaft 60, causing movement of shaft 60 with cam face 70 being urged forcefully against the cam surface 72 of the cam 66.

The cam 66 is moved about pivot pin 68 by cam surface 72 to extend its displacement surface 74 against the interior wall of the drill collar 14 and thereby to urge the section 38 and section 26 over against the opposing side of the wall of the drill collar 14.

The actuating shaft 60 is stopped once the kinetic energy imparted into the actuating shaft by the impact piston 76 has been dissipated in moving the tool 10 to the sidewall and locking the cam 66 and displacement surface 74 against the opposite side of the wall of drill pipe 14.

The downward movement of the actuating shaft has forced the buttress threads 82 into ratcheting connection with the buttress threads 86 of the ratchet sleeve 84, which retains the actuating shaft into down position, causing a locked position of the cam 66 against the inner wall of the drill collar 14.

In the meantime, the head piston 48 has been moved downwardly by the fluid pressure of the chemical 50 as far as permitted by the impact washer 80 within the counter bore of section 38.

In its lower position, such as shown in FIG. 3, the outer surface of the piston 48 is passed down into the annulus 46, allowing fluid communication through the annulus 46 from the interior of the tool 10 out through the jet orifice 44 onto the surface of the inner wall of drill collar 14.

The pressure exerted by the propellant continues to force the reactant chemical out through the jet orifice 44 until all the chemical has been ejected from the tool. The chemical, upon contact with the drill collar 14, reacts vigorously to oxidize the metal with the flow of the chemical also sweeping away the reaction products of the chemical with the drill collar metal.

Before the chemical is fully ejected from the tool 10, a port hole has been formed through the wall of the drill collar 14 into the annulus out between the drill collar and the well formation as shown in FIGS. 1 and 3. Also as shown, the hole produced by the acid is considerably larger than the internal diameter of the jet orifice 44.

After the chemical 50 is completely expended from the tool, the propellant gases follow through and reduce the pressure within the tool 10 to the same as that pressure within the drill collar 14. The slips in the slip section 26 are thereon released from forceful contact with the inner wall of the drill collar 14 and no longer restrain the tool against vertical movement.

Once the jetting cycle of the tool 10 has been completed and the slip section 26 released, the tool remains decentralized with the displacement surface 74 of the cam 66 remaining fixed against the inner wall of collar 14 by the force exerted by shaft 60 through the camming face 70, the camming surface 72 and through the cam 66 as positioned about pivot pin 68.

The tool is removed by first giving sharp pulls on the cable 12 to actuate the jar 22. The jar 22 produces an upward impact force on the tool 10 with each sharp pull of the cable 12. Usually, one to a very few of such pulls on the cable 12 will tend to move the cam 66 about pivot pin 68 and bring the camming surface 72 of cam 66 sharply against the camming face 70 of actuating shaft 60, thereby giving an upward impact force to the actuating shaft 60 within the section 38.

Such upward impact force is borne entirely by the shear pin 94 until the pin shears and allows the shaft to move upwardly toward its initial position and releasing the displacement surface 74 from the inner wall of collar 14.

Once the shaft has moved upwardly, then the entire tool may be pulled upwardly against the pivot pin 68 as necessary to move the cam 66 back into the slots 62 and 64.

Once the cam is released from against the surface of the inner wall of the drill collar, then the tool may be removed freely from the hole.

The tool 10 then may be removed from the drilling string to enable mud to be pumped down through the drill collar 14, out through the port 42 and back up the annulus of the well to establish circulation of drilling fluid of adequate weight to overcome any in situ pressure found in the well formation 20.

Under some conditions the cable 12 of well tool 10 may be extended out of the well through a packing or lubricator assembly (not shown) at the earth's surface which will permit such pumping of the drilling fluid through the port 42 with the tool 10 remaining in the drilling string.

Though only one embodiment of the invention is herein described, it will become apparent to those skilled in the art that variations and modifications may be made, all coming within the spirit of the invention as outlined in the appended claims.

We claim:

1. A method for increasing fluid flow circulation past the earth formations traversed by a well being drilled, the steps comprising:

(a) lowering a pressurable chemical reactant fluid jet stream type perforating means suspended from an electrical wireline through the drill pipe and drill collar of subsurface drilling apparatus and into a position within said drill collar where the fluid jetting orifice of said perforating apparatus is vertically positioned near the drill bit of said drilling apparatus;

(b) generating an actuating pressure within said perforating means;

(c) fixing said perforating means against vertical movement within said drill collar responsive to said actuating pressure;

(d) laterally moving the outlet of said jetting orifice against the inner sidewall of said drill collar in response to said actuating pressure to position said orifice for optimum reactive contact of chemical reactant flowing through said orifice against the face of said sidewall;

(e) perforating a flow port through the sidewall of said drill collar by forcing a chemical reactant out of said jetting orifice at high velocity in response to said actuating pressure into reactive contact with said drill collar sidewall; and (f) circulating fluid through said flow port in addition to any fluid circulating through said drill bit.

2. The method of claim 1 further including the step of heating said chemical reactant to a highly reactive elevated temperature within said perforating means by moving said reactant through a reactant heating means in response to said actuating pressure.

3. The method of claim 2 wherein said reactant heating means is comprised of a readily oxidizable material.

4. The method of claim 2 wherein said chemical reactant is comprised of a halogen oxidizer compound.

5. The method of claim 2 wherein said chemical reactant is comprised of bromine triflouride ($BrF_3$).

6. The method of claim 1 further including the step of withdrawing said perforating means from said well prior to circulating fluid through said flow port.

7. Apparatus for perforating a hole through the thick metal wall of a conduit such as a flow port through the sidewall well drilling collar, said apparatus being provided as an elongated, generally tubular chemical reactant perforating tool adapted for connection to an electrical wireline, the combination comprising:

(a) an electrically actuated fluid pressure generator;

(b) slip means adapted to fix said tool against axial movement within said conduit in response to pressure applied from said generator;

(c) a liquid jet orifice means defined out of the side of said tool and adapted to direct a liquid jet stream in a single direction;

(d) a quantity of liquid chemical reactant contained within said tool and adapted to be moved forcefully out from said jet orifice in response to pressure applied from said generator; and (e) lateral displacement means adapted to move said tool to address said jet orifice and said liquid jet stream directly toward the inside wall of said conduit in response to pressure applied from said generator.

8. The apparatus of claim 7 further including chemical reactor means disposed within said tool between said quantity of reactant and said jet orifice and adapted to heat said chemical reactant passing through said reactor means into a greater reactive state.

9. The apparatus of claim 8 wherein said chemical reactor means includes a readily oxidizable material.

10. The apparatus of claim 7 wherein said displacement means includes a drive shaft linearly movable in response to pressure applied from said generator and a cam means eccentrically mounted with said tool to be forced laterally out from said tool against the inner wall of said conduit responsive to movement by said drive shaft.

11. The apparatus of claim 10 wherein said displacement means includes a releasable latching means adapted to fix said cam into extended position against said inner wall.

12. The apparatus of claim 7 wherein said chemical reactant is comprised of a halogen oxidizer compound.

* * * * *